US005602567A

United States Patent [19]

Kanno

[11] Patent Number: 5,602,567

[45] Date of Patent: Feb. 11, 1997

[54] DISPLAY MONITOR

[75] Inventor: Masahiro Kanno, Nagasaki, Japan

[73] Assignee: Mitsubishi Denki Kabushiki Kaisha, Tokyo, Japan

[21] Appl. No.: 220,211

[22] Filed: Mar. 30, 1994

[30] Foreign Application Priority Data

Dec. 15, 1993 [JP] Japan ..... 5-315566

[51] Int. Cl.[6] ..... G09G 5/00

[52] U.S. Cl. ..... 345/132; 345/11; 345/185

[58] Field of Search ..... 345/121, 127, 345/129, 130, 132, 185, 133, 1, 2, 3, 10, 11

[56] References Cited

U.S. PATENT DOCUMENTS 5,276,458 1/1994 Lawdon ..... 345/132

FOREIGN PATENT DOCUMENTS 58-105340 6/1983 Japan ..... 345/127

2-305293 12/1990 Japan .

5-83719 4/1993 Japan .

2020061 11/1992 WIPO ..... 345/121

*Primary Examiner*—Richard Hjerpe

*Assistant Examiner*—Lun-Yi Lao

*Attorney, Agent, or Firm*—Burns, Doane, Swecker & Mathis, LLP

[57] ABSTRACT

A display monitor which has the monitor circuit 10 for driving the monitor 9 such as a cathode ray tube, the monitor control CPU 14, the EEPROM 11 which stores control data for monitor circuit 10, the RAM 12 which temporarily stores adjustment data of monitor circuit 10 necessary for a currently displayed image and the serial interface 8 which performs a data communication between the computer 1 and the monitor display 2. Based on a command received via the serial interface 8, the monitor control CPU 14 reads data in the EEPROM 11 and the RAM 12. Then, the monitor control CPU 14 sends the data to the computer 1 via the serial interface 8.

8 Claims, 5 Drawing Sheets

DISPLAY MONITOR

BACKGROUND OF THE INVENTION

1. Field of the Invention

This invention relates to a display monitor which receives commands from an external device such as a computer and controls a display position and a display size of the display monitor.

2. Description of the Prior Art

FIG. 8 is a block diagram showing a configuration of a conventional display monitor which has a communication function between a computer and the display monitor. In this figure, numeral 1 denotes a computer, numeral 2 denotes a display monitor which can control a display position and a display size of the display monitor based on a command received from the computer 1, numeral 3 denotes a Central Processing Unit (CPU) provided in the computer 1, numeral 4 denotes a video interface which receives data from the CPU 3 and sends image signals to the display monitor 2, numeral 5 denotes a video cable for providing the image signals from the computer 1 to the display monitor 2, numeral 6 denotes a serial interface provided in the computer 1, which performs a serial data communication between the display monitor 2 and the computer 1, numeral 7 denotes an interface cable for sending commands from the serial interface 6 to the display monitor 2. Next, the elements in the display monitor 2 are explained. Numeral 8 denotes a serial interface which performs a serial communication between the computer 1 and the display monitor 2 via the interface cable 7, numeral 9 denotes a monitor such as a Cathode Ray Tube (CRT), numeral 10 denotes a monitor circuit which drives the monitor 9 according to the video signals supplied via the video cable 5, numeral 11 denotes an Electrically Erasable and Programmable Read Only Memory (EEPROM) which stores data necessary for controlling the monitor circuit 10, numeral 12 denotes a Random Access Memory (RAM) for storing adjustment data of the monitor circuit 10 for currently displayed image, numeral 13 denotes a monitor control CPU which outputs adjustment data stored in the RAM 12 to the monitor circuit 10 via a Digital to Analog (D/A) converter which is not shown in the figure. The monitor control CPU 13 controls the monitor circuit 10 according to the commands received by the serial interface 8.

The display monitor 2 receives commands of the CPU 3 by performing a communication between the serial interfaces 6 and 8, and the commands are sent to the monitor control CPU 13. The monitor control CPU 13 controls the monitor circuit 10 according to the commands so as to enlarge the screen size of the monitor 9 or to change the screen position of the monitor 9.

FIG. 9 is a sequence diagram of data communication between the computer 1 and the display monitor 2 in the case where the screen size is enlarged, for example. As shown in this figure, the CPU 3 of the computer 1 sends a command to the display monitor 2, which indicates that the screen size is to be enlarged. In this case, the serial interface 8 sends an acknowledge signal back to the computer 1. The monitor circuit 10 increases the voltage applied to a deflection circuit by a predetermined amount in order to enlarge the screen size of the monitor 9 under control of the monitor CPU 13. In this prior art, the CPU 3 sends such a command several times to obtain a desired screen size.

Adjustment data for parameters of the monitor circuit 10 corresponding to the currently displayed image are stored in the RAM 12. Monitor control CPU 13 sets the adjustment data in RAM 12 corresponding to the frequencies of vertical and horizontal synchronous signals of the supplied video signals for example. Further, the CPU 13 transfers data in the EEPROM 11 to the RAM 12. Moreover, the adjustment data are renewed when adjustment of the screen is performed. Data are stored in the EEPROM 11 corresponding to parameters such as the frequencies of synchronous signals when the display monitor is produced at a factory.

The above explained conventional monitor display has the following drawbacks. Firstly, when enlarging the screen size of the monitor 9, it is necessary to supply a plurality of commands to obtain a desired screen size. Secondly, it is impossible to know the parameter values of the display monitor 2 from the outside of the display monitor 2 and it is also impossible to confirm whether the parameters of the display monitor 2 are properly set based on a received command or not. Thirdly, data values stored in the EEPROM 11 cannot be known and cannot be changed at all once the display monitor is completed.

SUMMARY OF THE INVENTION

In view of the foregoing, the present invention is accomplished in view of the above drawbacks of the prior art display monitor.

Accordingly, the object of the invention is to obtain a display monitor whose internal information can be recognized by a computer which is connected to the display monitor.

In order to accomplish the above object, in a display monitor according to the present invention, a monitor control CPU reads data stored in a non-volatile or a rewritable memory based on the command received from an external device such as a computer via an interface. After that, the monitor display sends the data to the external device. Therefore, the data stored in the non-volatile memory or the rewritable memory can be recognized at the external device.

Further, the monitor control CPU replaces data of the adjustment item in the rewritable memory with data corresponding to an adjustment amount based on a received command. The data in the rewritable memory are transferred to the monitor circuit which drives a monitor such as a CRT. Therefore, adjustment data of the monitor circuit in operation can be replaced by inputting only one command. Namely, a change in screen size can be obtained by inputting only one command.

Moreover, based on an inputted command, the monitor control CPU reads out the permissible range of an adjustment item in the non-volatile memory and sends the range to the external device. Therefore, the permissible range of an adjustment item can be recognized at the external device and invalid data input to the display monitor can be avoided.

Further, based on an inputted command the monitor control CPU reads out parameters of the monitor circuit, which are set in the non-volatile memory when the display monitor is produced. Then, the monitor control CPU sends the parameters to the external device. Therefore, previously set parameters can be recognized at the external device.

Furthermore, based on an inputted command the monitor control CPU reads out a type number peculiar to the display monitor, which is stored in the non-volatile memory. Then, the monitor control CPU sends the type number to the external device. Therefore, rewritable adjustment items and non-rewritable adjustment items are known based on the type number.

Moreover, the monitor control CPU extracts one of vertical synchronous frequency and horizontal synchronous frequency from a video signal inputted to the monitor display. Then, the monitor control CPU sends the extracted frequency to the external device. Therefore, these frequencies can be recognized at the external device.

The above and other objects, features and advantages of the present invention will become more apparent from the following description and appended claims.

DETAILED DESCRIPTION OF THE PREFERRED EMBODIMENTS

The preferred embodiments of the invention will be explained in detail with reference to the drawings.

EMBODIMENT 1

Figure 1:
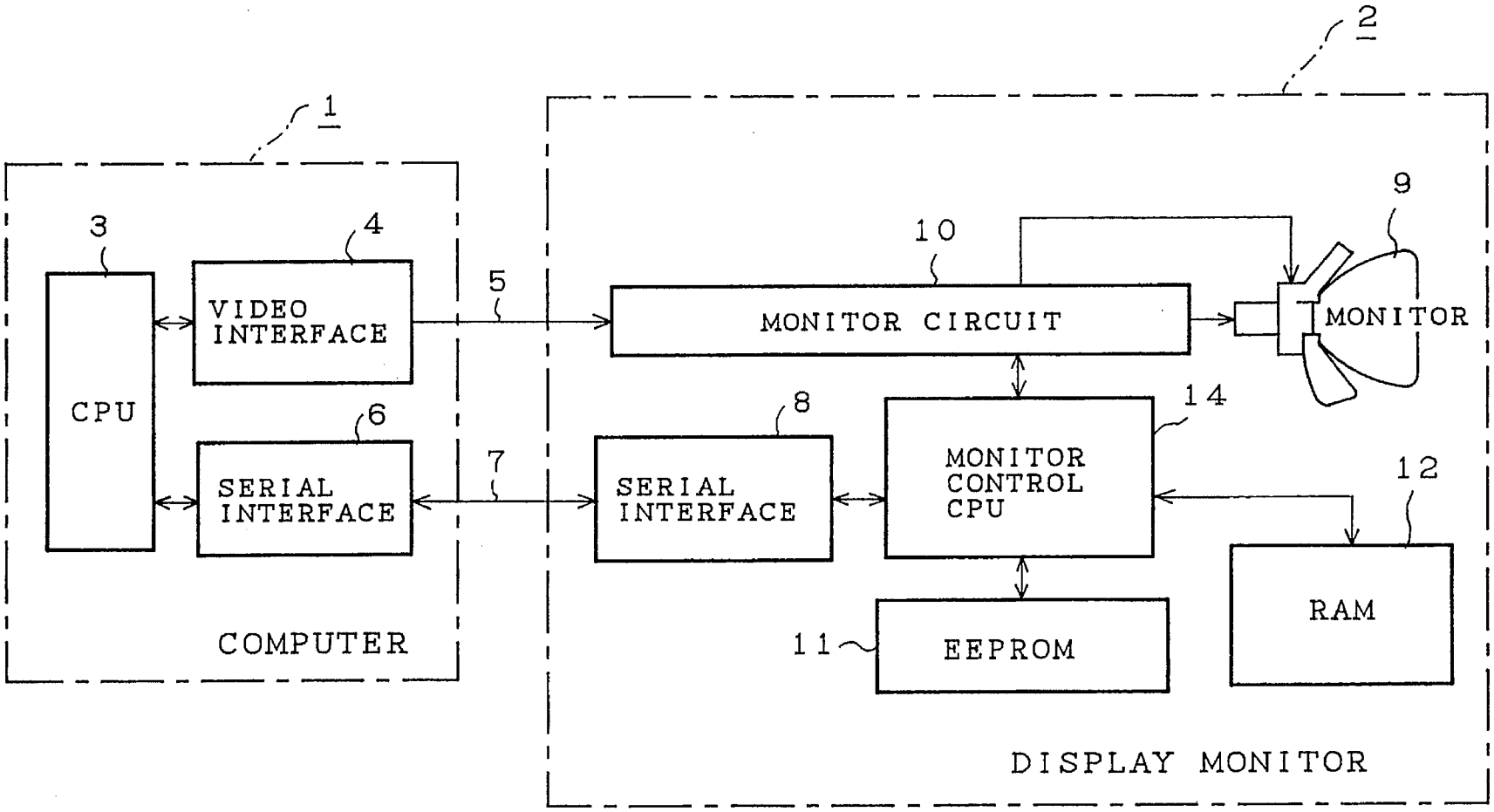
FIG. 1 is a block diagram showing a configuration of a display monitor according to the present invention and a computer connected to the display monitor.
Figure 8:
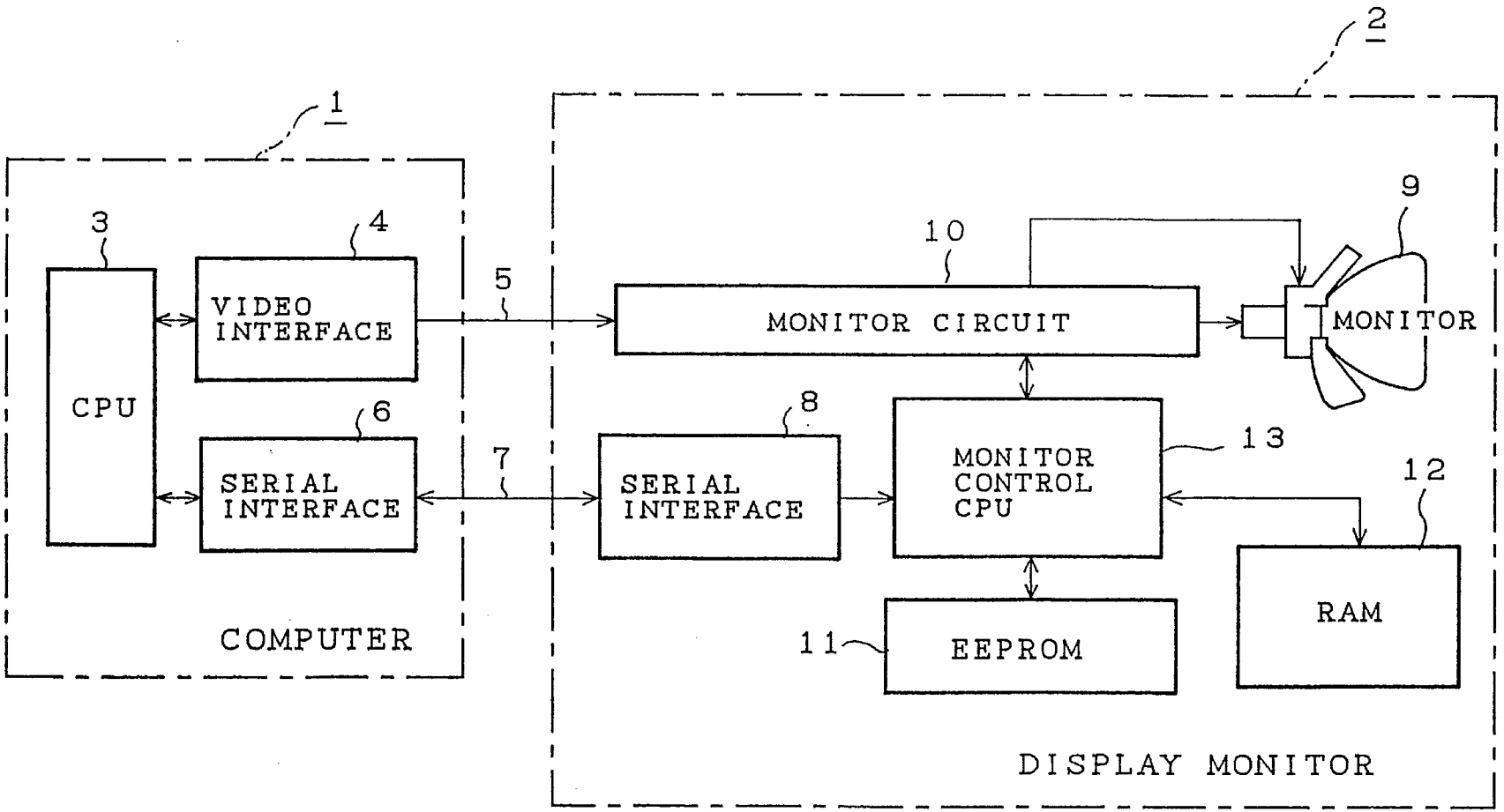
FIG. 8 (PRIOR ART)
FIG. 8 is a block diagram showing a configuration of a conventional display monitor which has a communication function between a computer and the display monitor.
Figure 9:
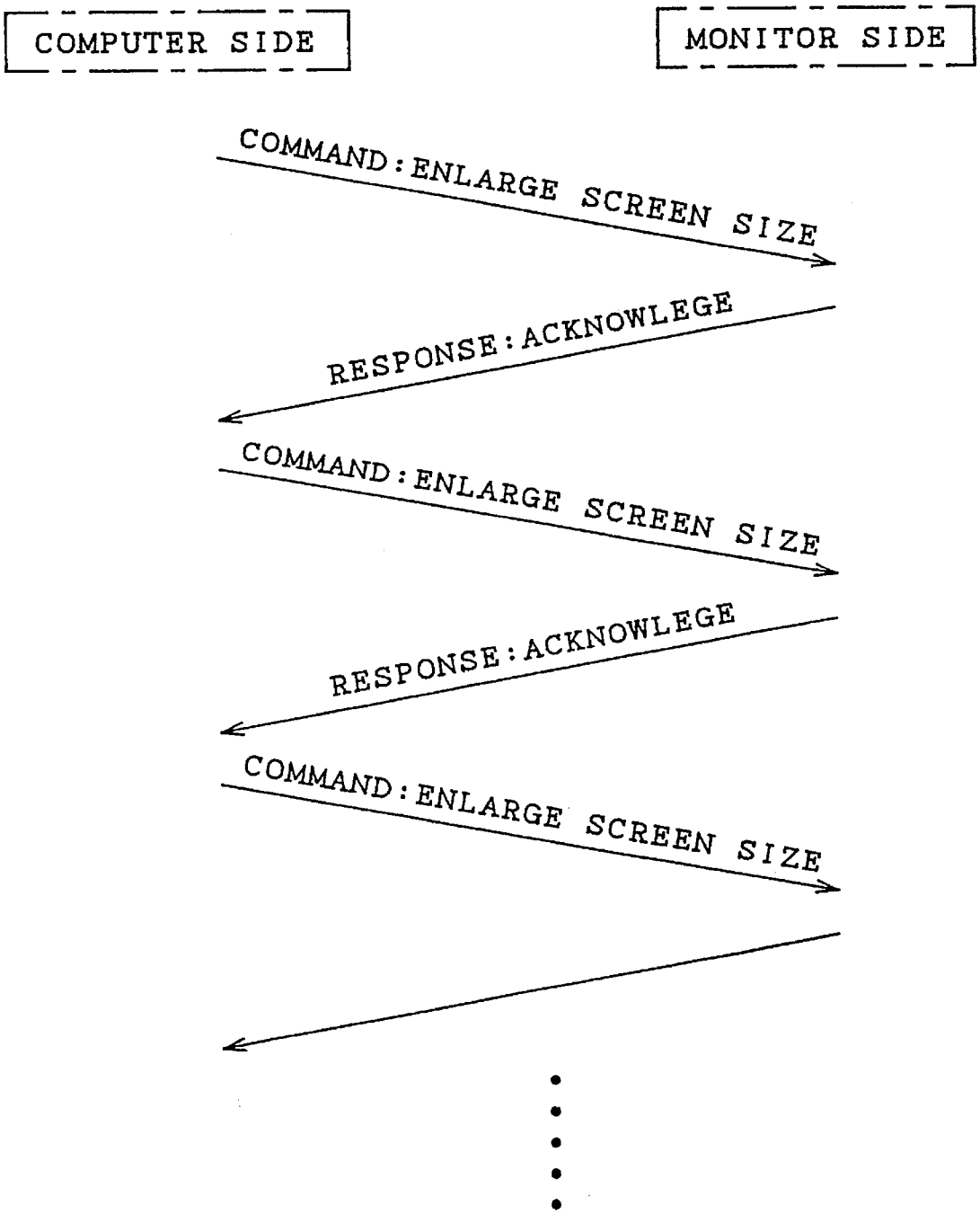
FIG. 9 (PRIOR ART)
FIG. 9 is a sequence diagram of data communication between a computer and a display monitor in the case where the screen size is enlarged, for example.

FIG. 1 is a block diagram showing a configuration of a display monitor according to the present invention and a computer connected to the display monitor. The same reference numbers are attached to the same components as in FIG. 8 and duplicate explanations thereof are omitted. In this figure, numeral 14 denotes a monitor control CPU which reads data in the EEPROM 11 as a non-volatile memory or the RAM 12 as a rewritable memory and transmits the data outside of the display monitor 2.

Figure 2:
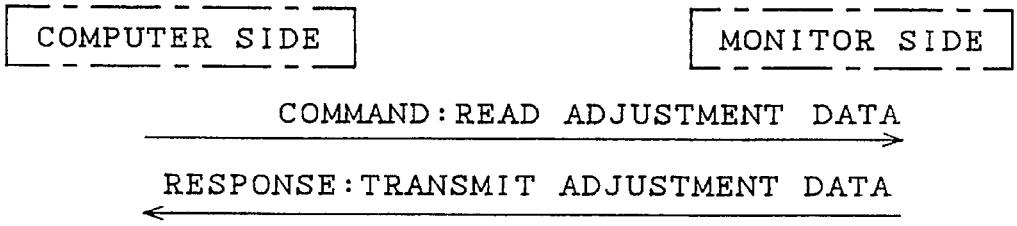
FIG. 2 is a sequence diagram of data communication between a computer and a display monitor in the case where adjustment data of the display monitor are read out.

FIG. 2 is a sequence diagram of data communication between the computer 1 and the display monitor 2 in the case where adjustment data are read out. In this embodiment, a bidirectional data communication is performed between the serial interface 8 and the monitor control CPU 14. When the command requiring display monitor to read out the data is received from the CPU 3 of the computer 1 via the serial interface 8, the monitor control CPU 14 reads the current adjustment data for the screen of the monitor 9 and sends these data to the CPU 3 of the computer 1 via the serial interface 8. Thus, the current adjustment data of the monitor circuit 10 can be confirmed by using a software running on the computer 1. Further, when the computer 1 commands the display monitor 2 to enlarge the screen size of the monitor 9 for example, whether the change of adjustment data conforms to the command or not can be confirmed. The monitor control CPU 14 may be designed to read data in the EEPROM 12 and to send the data to the CPU 3 of the computer 1 via the serial interface 8.

EMBODIMENT 2

Figure 3:
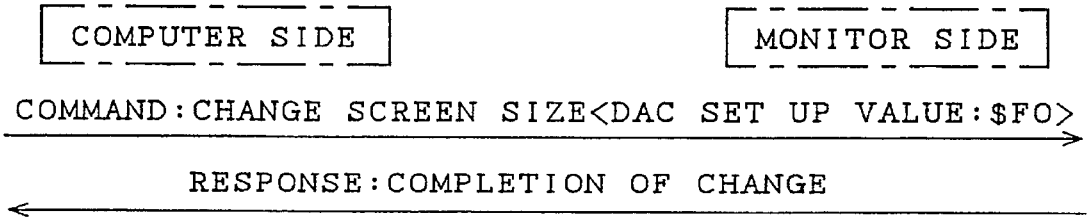
FIG. 3 is a sequence diagram of data communication between a computer and a display monitor in the case where the computer sends, to the display monitor, a command indicative of an adjustment item and adjustment amount corresponding to this item.

FIG. 3 is a sequence diagram of data communication between the computer 1 and the display monitor 2 in the case where the computer 1 sends, to the display monitor 2, a command indicative of an adjustment item and adjustment amount corresponding to this item. In this embodiment, the CPU 3 of the computer 1 sends a command indicative of an adjustment item and corresponding adjustment amount. According to the command, the monitor control CPU 14 replaces the adjustment data for the monitor circuit 10 in operation, which are stored in the RAM 12. As shown in this figure, the computer 1 sends "CHANGE SCREEN SIZE" as an adjustment item and "DAC SET UP VALUE $F0" as an adjustment amount corresponding to the item in a command. When the monitor control CPU 14 receives the commands, it replaces the screen size data in the adjustment data stored in the RAM 12 with the set up value $F0. Further, the monitor control CPU 14 sends the value $F0 to the D/A converter to change adjustment value of the monitor circuit 10. The monitor circuit 10 changes the screen size on the monitor 9 according to the adjustment value. Therefore, it is sufficient to input only one command to the display monitor 2 in order to enlarge the screen size.

EMBODIMENT 3

Figure 4:
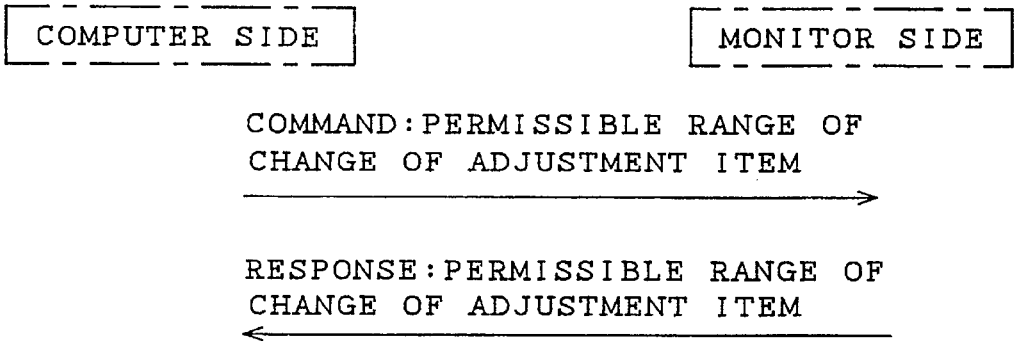
FIG. 4 is a sequence diagram of a data communication between a computer and a display monitor in the case where the computer inquires about a permissible range of an adjustment item of the monitor circuit.

FIG. 4 is a sequence diagram of a data communication between the computer 1 and the display monitor 2 in the case where the computer 1 inquires about a permissible range of an adjustment item of the monitor circuit 10. In this embodiment, computer 1 sends a command to inquire about a permissible range of an adjustment item of the monitor circuit 10. When the display monitor 2 receives the command, the monitor control CPU 14 reads out the permissible range data of the adjustment item of the monitor circuit 10 and sends the data back to the computer 1. Generally, when using an 8 bit D/A converter, input data can have a value in a range from 0 to 255. However, the values of such data are sometimes limited to a narrower range depending on the adjustment item. According to this embodiment, input of invalid data can be avoided because a permissible range of an adjustment data can be previously recognized by reading out data in the EEPROM 11. Even if the permissible range of an adjustment data is changed according to design change, the computer 1 is able to cope with this change.

EMBODIMENT 4

Figure 5:
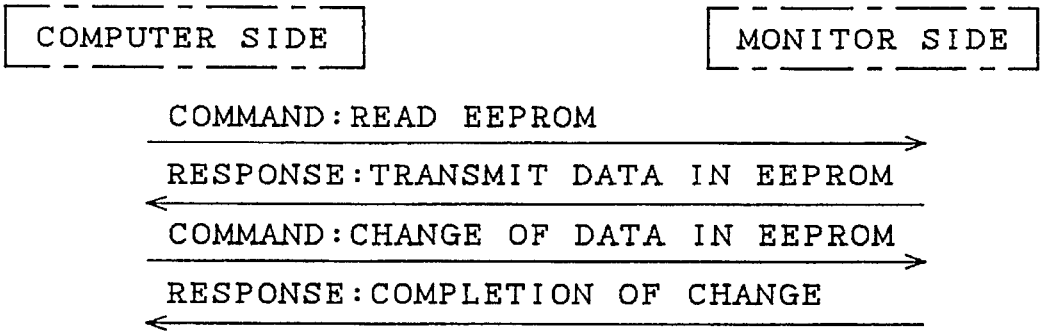
FIG. 5 is a sequence diagram of a data communication between a computer and a display monitor in the case where the data in an EEPROM are changed according to commands of the computer.

FIG. 5 is a sequence diagram of a data communication between the computer 1 and the display monitor 2 in the case where the data in the EEPROM 11 are changed according to commands of the computer 1. In this embodiment, the computer 1 sends, to the display monitor 2, a command to inquire about parameters of the display monitor 2. When the display monitor 2 receives the command, the monitor control CPU 14 reads out the previously set parameters of the monitor control circuit 10, which are stored in the EEPROM 11 and sends these parameters to the computer 1. These parameters include a screen size, a screen position, a distortion adjustment value, corresponding to horizontal and vertical synchronous signals. These parameters are set when the display monitor 2 is produced at a factory. If it is necessary to change the values of these parameters, computer 1 sends, to the display monitor 2, a command indicative of changing data in the EEPROM 11 and the data to be changed. When the display monitor 2 receives this command and data, the monitor control CPU 14 replaces data in the EEPROM 11 with the received data and sends a response indicative of completion of data change to the computer 1. Therefore, according to this embodiment, the parameters stored in the EEPROM 11 can be changed by computer 1 in addition that the values of the parameters can be recognized.

EMBODIMENT 5

Figure 6:
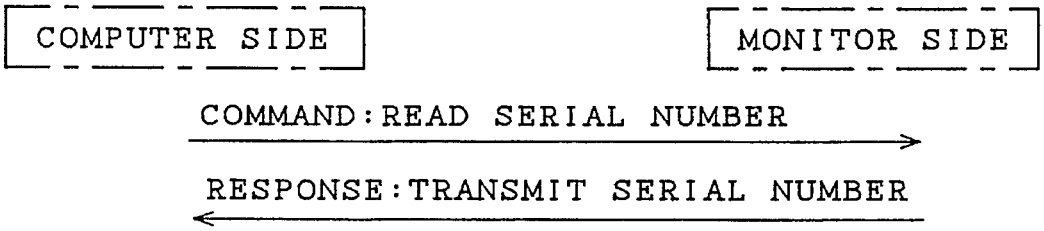
FIG. 6 is a sequence diagram of a data communication between a computer and a display monitor in the case where the computer inquires about the serial number of the display monitor.

FIG. 6 is a sequence diagram of a data communication between the computer 1 and the display monitor 2 in the case where the computer 1 inquires about the type number of the display monitor 2. In this embodiment, information including a serial number peculiar to the display monitor 2, a type of the display monitor 2, and a version of the monitor control CPU 14 is previously stored in EEPROM 11. The CPU 3 of the computer 1 sends, to the display monitor 2, a command indicative of inquiring about the above information. When the display monitor 2 receives this command, the monitor control CPU 14 reads out the information and sends it to the computer 1. Therefore, the information including a serial number peculiar to the display monitor 2, a type of the display monitor 2, and a version of the monitor control CPU 14 is available at the computer 1 when the display monitor 2 is repaired for example. From the information, adjustable items and non-adjustable items can be recognized by the computer 1.

EMBODIMENT 6

Figure 7:
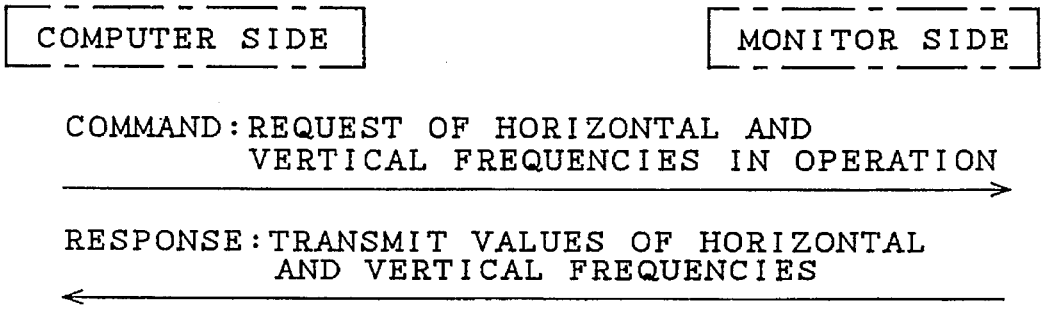
FIG. 7 is a sequence diagram of a data communication between a computer and a display monitor in the case where the computer inquires about the frequencies of horizontal and vertical synchronous signals.

FIG. 7 is a sequence diagram of a data communication between computer 1 and display monitor 2 in the case where the computer 1 inquires about the frequencies of horizontal and vertical synchronous signals inputted to the display monitor 2. In this embodiment, the computer 1 sends, to the display monitor 2, a command indicative of a request to send horizontal and vertical frequencies of synchronous signals. When the display monitor 2 receives this command, the monitor control CPU 14 extracts the horizontal and vertical frequencies of the synchronous signals and sends them back to the computer 1. Therefore, by using a software running on the computer 1, horizontal and vertical frequencies of synchronous signals in operation can be recognized.

Apparently, at least two of the above embodiments 1–6 can be combined each other. Further, a display unit may be provided in the computer 1 for displaying the responses received from the display monitor 2. In the above embodiments, although, the serial interface 8, the EEPROM 11 and the RAM 12 are separate from the monitor control CPU 14, all of or some of these components may be included in the monitor control CPU 14. Moreover, the serial interface 8 may have an exclusive CPU for dealing with the communication between the display monitor 2 and the computer 1. All of the adjustment data may be read out at a time or one of the data may be read out by designating an adjustment item. Although, in the above embodiments, the screen adjustment data are represented as a hexadecimal code to be supplied to a D/A converter, these data may be represented as a character code. Although, in the above embodiments, the computer 1 sends a command indicative of inquiring about the permissible range of an adjustment item independently, the display monitor 2 may be constructed as it sends the permissible range together with the adjustment data when the display monitor receives a command indicative of reading out the adjustment data. The adjustment data to be sent out may be represented as binary codes, hexadecimal codes or character codes. Furthermore, in the above embodiments, a command and a response are transmitted once between the computer 1 and the display monitor 2, however, in order to perform a certain procedure, plurality of commands and responses may be transmitted. This allows the communication between the computer 1 and the monitor display 2 to be more reliable.

What is claimed is:

1. A display monitor, comprising:

an interface which receives a command issued from an external device and sends data to the external device;

a monitor circuit which drives a display monitor to produce an image on a screen of the monitor according to a video signal inputted to the display monitor;

a rewritable memory which temporarily stores adjustment data used by the monitor circuit for a currently displayed image;

means for transferring the adjustment data in the rewritable memory to the monitor circuit;

means for reading out the adjustment data from the rewritable memory and for sending the adjustment data to the external device via the interface;

means for recognizing a command inputted via the interface from the external device, said command identifying an adjustment parameter and specifying an adjustment amount; and means, responsive to the command, for replacing data in said rewritable memory with data corresponding to said adjustment parameter and adjustment amount.

2. A display monitor according to claim 1, further comprising a non-volatile memory which stores control data of the monitor circuit and means for reading out the control data in the non-volatile memory and for sending the control data to the external device.

3. A display monitor according to claim 2, further comprising means for recognizing a command inputted via the interface from the external device, and means, responsive to the command, for reading a permissible range in the non-volatile memory corresponding to a received adjustment item and for sending the permissible range to the external device via the interface.

4. A display monitor according to claim 2, further comprising means for recognizing a command inputted via the interface from the external device, and means, responsive to the command, for reading a parameter in the non-volatile memory, which is set when the display monitor is produced and for sending the parameter to the external device via the interface.

5. A display monitor according to claim 2, further comprising means for recognizing a command inputted via the interface from the external device, and means, responsive to the command, for reading a type number peculiar to the display monitor in the non-volatile memory and for sending the number to the external device via the interface.

6. A display monitor according to claim 2, further comprising means for recognizing a command inputted via the interface from the external device, and means, responsive to the command, for extracting at least one of vertical synchronous frequency and horizontal synchronous frequency from the video signal inputted to the display monitor and means for sending the extracted frequency to the external device via the interface.

7. A method for changing one or more parameters of a display device via an external device, said display device including a non-volatile memory device and an interface circuit connecting said display device with said external device, the method including the steps of:

transmitting a first command from said external device to said display device, said first command identifying one or more display parameters stored within said non-volatile memory;

receiving said first command at said display device;

reading out said parameters identified by said first command from said non-volatile memory;

transmitting said read parameters to said external device;

receiving said read parameters at said external device; and transmitting a second command to said display device instructing said display device to change one or more parameters stored within said non-volatile memory, said second command including replacement data;

receiving said second command at said display device;

replacing said one or more parameters identified by said second command with said replacement data included with said second command.

8. The method of claim 7, including the further step of:

transmitting a response from said display device to said external device indicating that said display device has completed replacement of said one or more parameters, as instructed by said second command.

* * * * *